US011442400B2

(12) United States Patent
Sato et al.

(10) Patent No.: US 11,442,400 B2
(45) Date of Patent: Sep. 13, 2022

(54) IMAGE FORMING APPARATUS WITH LED UNIT MOVABLE FROM AN EXPOSURE POSITION TO A CLEANING POSITION

(71) Applicant: BROTHER KOGYO KABUSHIKI KAISHA, Nagoya (JP)

(72) Inventors: Shougo Sato, Seto (JP); Koji Ogawa, Owariasahi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/186,547

(22) Filed: Feb. 26, 2021

(65) Prior Publication Data

US 2021/0271201 A1 Sep. 2, 2021

(30) Foreign Application Priority Data

Mar. 2, 2020 (JP) ..... JP2020-035374

(51) Int. Cl.
*G03G 21/16* (2006.01)
*G03G 15/04* (2006.01)

(52) U.S. Cl.
CPC ... *G03G 21/1666* (2013.01); *G03G 15/04054* (2013.01); *G03G 21/1604* (2013.01); *G03G 21/1619* (2013.01); *G03G 21/1647* (2013.01); *G03G 21/1628* (2013.01); *G03G 21/1671* (2013.01); *G03G 2215/0897* (2013.01); *G03G 2221/0005* (2013.01);
(Continued)

(58) Field of Classification Search
CPC ..... G03G 15/11; G03G 15/04054; G03G 15/052; G03G 21/007; G03G 21/1604; G03G 21/1619; G03G 21/1628; G03G 21/1647; G03G 21/1666; G03G 2215/0897; G03G 2221/0005; G03G 2221/0026; G03G 2221/0047; G03G 2221/1636
See application file for complete search history.

(56) References Cited

U.S. PATENT DOCUMENTS

2007/0160388 A1* 7/2007 Yoshimura ..... G03G 21/1842 399/111
2009/0087210 A1 4/2009 Terao et al.
(Continued)

FOREIGN PATENT DOCUMENTS

JP 2-249667 A 10/1990
JP 6-249767 A 9/1993
(Continued)

*Primary Examiner* — Joseph S Wong
(74) *Attorney, Agent, or Firm* — Merchant & Gould P.C.

(57) ABSTRACT

An image forming apparatus includes a photosensitive drum, an LED unit, and a housing. The LED unit is configured to expose the photosensitive drum. The LED unit has a light emitting surface. The housing includes a discharge portion and a discharge tray. The discharge portion has a discharge opening configured to discharge a sheet. The sheet discharged from the discharge opening is placed on the discharge tray. The discharge tray has a cleaning opening for cleaning the light emitting surface of the LED unit. The LED unit is configured to move between: a first position at which the LED unit exposes the photosensitive drum; and a second position at which the light emitting surface is closer to the cleaning opening than a state where the LED unit is located at the first position.

20 Claims, 6 Drawing Sheets

(52) U.S. Cl.
CPC ..... *G03G 2221/0026* (2013.01); *G03G 2221/0047* (2013.01); *G03G 2221/1636* (2013.01)

(56) References Cited

U.S. PATENT DOCUMENTS

| | | | | |
|---|---|---|---|---|
| 2013/0259516 | A1* | 10/2013 | Ikeda | G03G 21/1666 399/110 |
| 2015/0185689 | A1* | 7/2015 | Tanaka | G03G 21/1832 399/92 |
| 2015/0277365 | A1* | 10/2015 | Sato | G03G 21/1846 399/111 |
| 2017/0371292 | A1* | 12/2017 | Narita | G03G 15/04 |
| 2018/0095406 | A1* | 4/2018 | Sato | G03G 21/1666 |

FOREIGN PATENT DOCUMENTS

| | | | |
|---|---|---|---|
| JP | 7-232450 | A | 9/1995 |
| JP | 7-314779 | A | 12/1995 |
| JP | 2004-333959 | A | 11/2004 |
| JP | 2008-221587 | A | 9/2008 |
| JP | 2009-086151 | A | 4/2009 |
| JP | 2011-000780 | A | 1/2011 |
| JP | 2013-214118 | A | 10/2013 |
| JP | 2014-224858 | A | 12/2014 |

* cited by examiner

IMAGE FORMING APPARATUS WITH LED UNIT MOVABLE FROM AN EXPOSURE POSITION TO A CLEANING POSITION

CROSS REFERENCE TO RELATED APPLICATIONS

This application claims priority from Japanese Patent Application No. 2020-035374 filed Mar. 2, 2020. The entire content of the priority application is incorporated herein by reference.

TECHNICAL FIELD

This disclosure relates to an image forming apparatus.

BACKGROUND

Conventionally, an image forming apparatus includes a housing, a drum unit, and an LED unit. The drum unit includes a photosensitive drum. The LED unit moves between a first position and a second position. In a state where the drum unit is attached to the housing and the LED unit is located at the first position, the LED unit is capable of exposing the photosensitive drum. In a state where the drum unit is pulled out of the housing and the LED unit is located at the second position, the light emitting surface of the LED unit is cleanable.

SUMMARY

According to one aspect, this specification discloses an image forming apparatus. The image forming apparatus includes a photosensitive drum, an LED unit, and a housing. The LED unit is configured to expose the photosensitive drum. The LED unit has a light emitting surface. The housing includes a discharge portion and a discharge tray. The discharge portion has a discharge opening configured to discharge a sheet. The sheet discharged from the discharge opening is placed on the discharge tray. The discharge tray has a cleaning opening for cleaning the light emitting surface of the LED unit. The LED unit is configured to move between: a first position at which the LED unit exposes the photosensitive drum; and a second position at which the light emitting surface is closer to the cleaning opening than a state where the LED unit is located at the first position.

BRIEF DESCRIPTION OF THE DRAWINGS

Embodiments in accordance with this disclosure will be described in detail with reference to the following figures wherein.

DETAILED DESCRIPTION

In the above image forming apparatus, in order to clean the light emitting surface of the LED unit, it is necessary to move the LED unit from the first position to the second position after pulling out the drum unit from the housing. Thus, cleaning the light emitting surface of the LED unit is cumbersome.

In view of the foregoing, an aspect of an objective of this disclosure is to provide an image forming apparatus in which the light emitting surface of the LED unit can be cleaned smoothly.

1. Image Forming Apparatus 1

An image forming apparatus 1 will be described with reference to FIGS. 1 to 3B.

Figure 1:
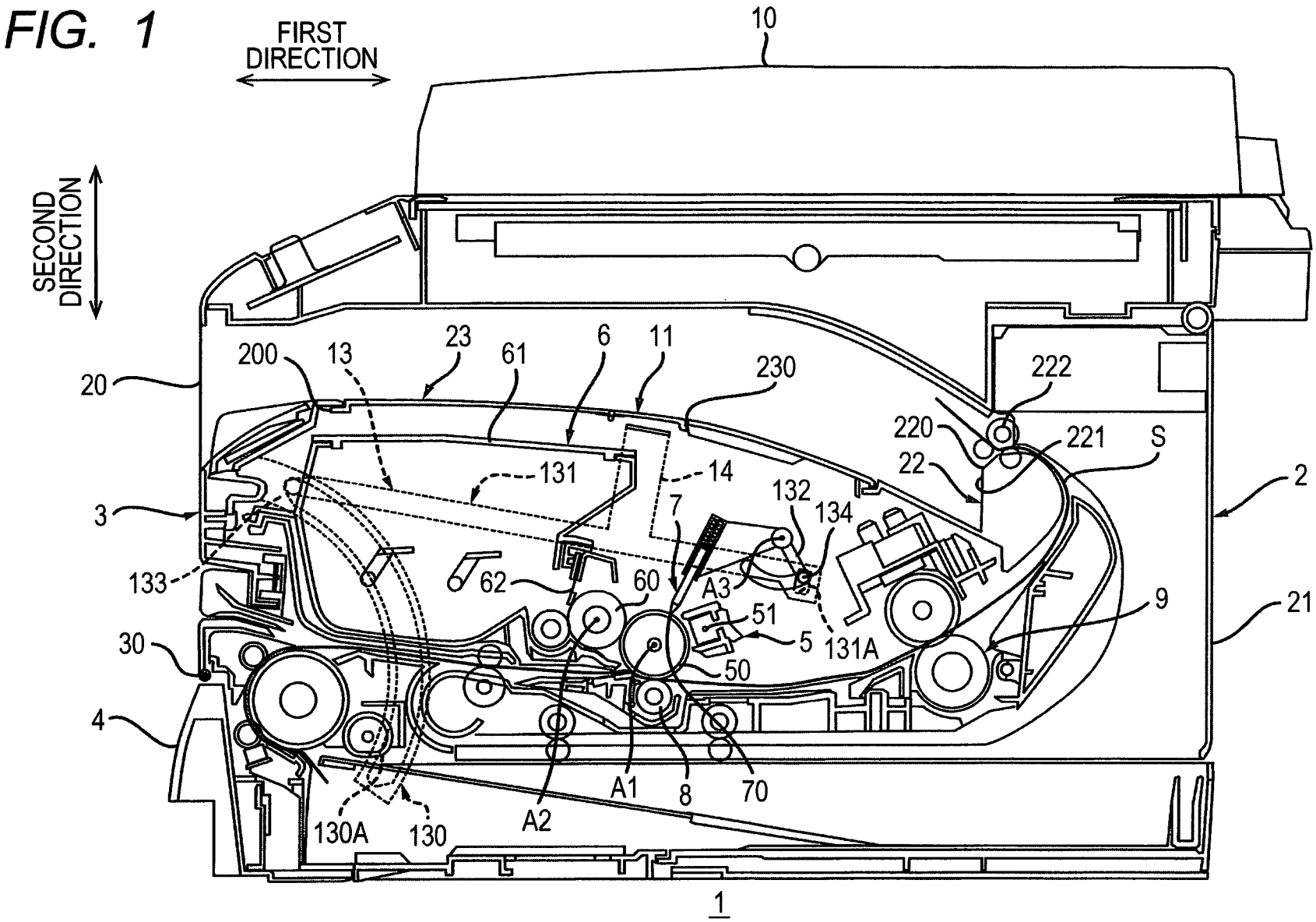
FIG. 1 is a cross-sectional view of an image forming apparatus of a first embodiment, showing a state where a second cover is located at a second closed position.

As shown in FIG. 1, the image forming apparatus 1 includes a housing 2, a second cover 3, a sheet cassette 4, a drum unit 5, a development unit 6, an LED unit 7, a transfer roller 8, and a fixing device 9, and a scanner 10. The image forming apparatus 1 is an image forming apparatus dedicated to monochrome printing. Thus, the image forming apparatus 1 includes one drum unit 5 and one development unit 6.

1.1 Housing 2

The housing 2 accommodates the sheet cassette 4, the drum unit 5, the development unit 6, the LED unit 7, the transfer roller 8, and the fixing device 9. The housing 2 includes a first side wall 20, a second side wall 21, a discharge portion 22, and a discharge tray 23.

1.1.1 First Side Wall 20 and Second Side Wall 21

The first side wall 20 is located at one end of the housing 2 in the first direction. The second side wall 21 is located at the other end of the housing 2 in the first direction. The first side wall 20 extends in the second direction. The second direction intersects the first direction. Specifically, the second direction is the vertical direction. The first side wall 20 has an opening 200. The second side wall 21 is spaced apart from the first side wall 20 in the first direction. The second side wall 21 extends in the second direction.

1.1.2 Discharge Portion 22

A discharge portion 22 is located at one end of the housing 2 in the second direction. Specifically, the discharge portion 22 is located at the upper end of the housing 2. The discharge portion 22 is located at the opposite side of the sheet cassette 4 with respect to the fixing device 9 in the second direction. The discharge portion 22 includes a discharge wall 221 and a discharge roller 222.

The discharge wall 221 is located between the first side wall 20 and the second side wall 21 in the first direction. The discharge wall 221 extends in the second direction. The discharge wall 221 has a discharge opening 220. In other words, the discharge portion 22 has the discharge opening 220.

The discharge roller 222 is located within the discharge opening 220. The discharge roller 222 conveys the sheet S that has passed through the fixing device 9 toward the discharge tray 23. With this operation, the discharge opening 220 discharges the sheet S.

1.1.3 Discharge Tray 23

The discharge tray 23 receives the sheet S discharged from the discharge opening 220. The discharge tray 23 is located at one end of the housing 2 in the second direction. Specifically, the discharge tray 23 constitutes the upper surface of the housing 2. The discharge tray 23 is located at the opposite side of the second side wall 21 with respect to the discharge portion 22 in the first direction. The discharge tray 23 is located between the discharge wall 221 and the first side wall 20 in the first direction.

The discharge tray 23 extends in the first direction. The discharge tray 23 has one end and the other end in the first direction. The one end of the discharge tray 23 in the first direction is connected to the discharge wall 221. The other end of the discharge tray 23 in the first direction is connected to the first side wall 20.

The discharge tray 23 has a cleaning opening 230. The cleaning opening 230 is an opening for cleaning a light emitting surface 70 of the LED unit 7. The light emitting surface 70 will be described later. The cleaning opening 230 is located away from the discharge wall 221 in the first direction.

1.2 Second Cover 3

Figure 2:
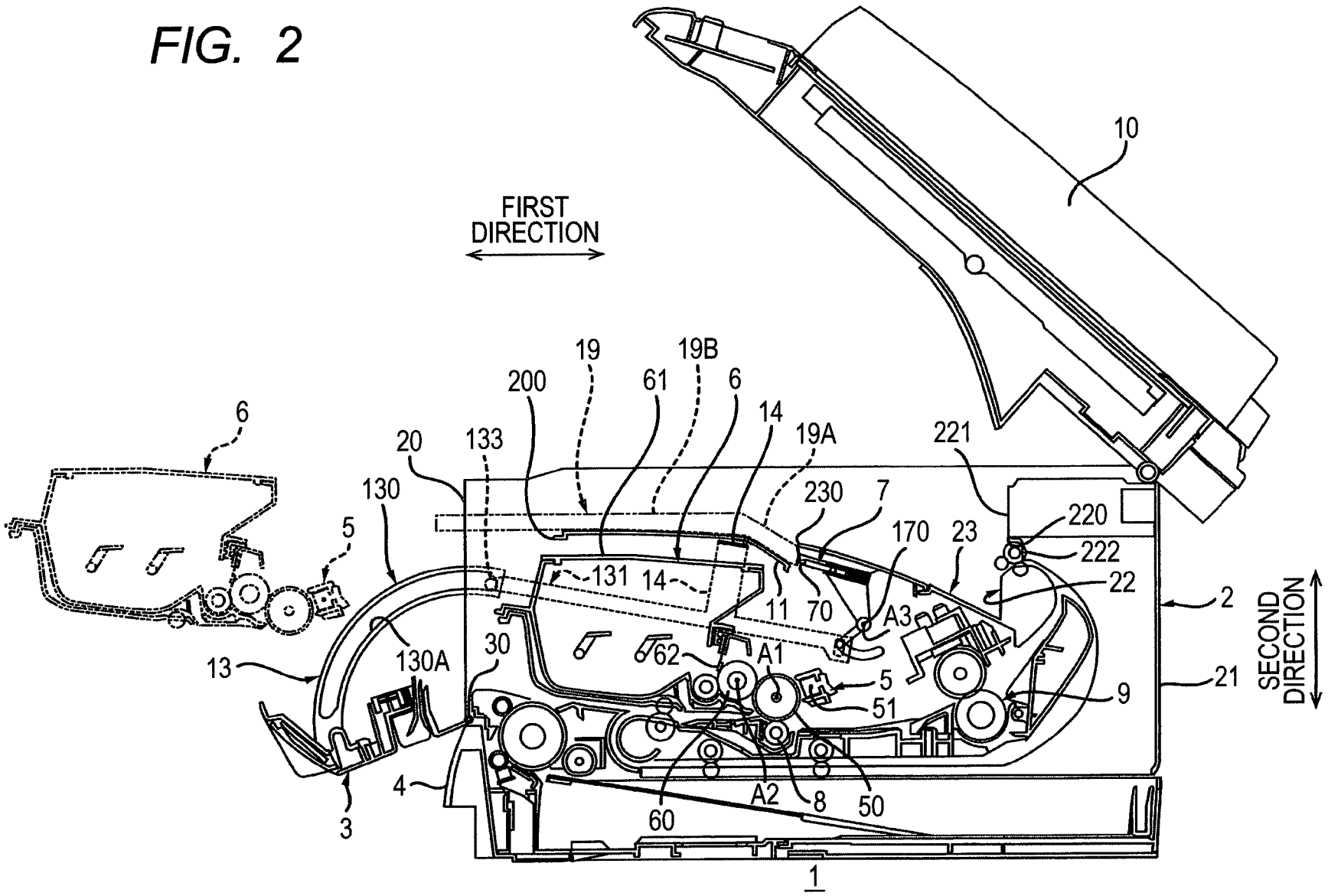
FIG. 2 shows the image forming apparatus shown in FIG. 1 in which the second cover is located at a second open position.

The second cover 3 is configured to move between a second closed position (see FIG. 1) and a second open position (see FIG. 2). In a state where the second cover 3 is located at the second closed position, the second cover 3 closes the opening 200 (see FIG. 1). In a state where the second cover 3 is located at the second open position, the opening 200 opens (see FIG. 2). The second cover 3 is configured to rotatably move about a second cover shaft 30 between the second closed position and the second open position. The second cover shaft 30 extends in a third direction. The third direction intersects the first direction and the second direction.

1.3 Sheet Cassette 4

The sheet cassette 4 is configured to accommodate a sheet S. The sheet S in the sheet cassette 4 is conveyed toward the transfer roller 8.

1.4 Drum Unit 5

In a state where the second cover 3 is located at the second open position, the drum unit 5 is attachable to the housing 2 through the opening 200 (see FIG. 2). The drum unit 5 includes a photosensitive drum 50 and a charging device 51. In other words, the image forming apparatus 1 includes the photosensitive drum 50.

1.4.1 Photosensitive Drum 50

The photosensitive drum 50 extends in the third direction. The photosensitive drum 50 has a cylindrical shape. The photosensitive drum 50 is rotatable about an axis A1. The axis A1 extends in the third direction. In a state where the drum unit 5 is attached to the housing 2, the axis A1 of the photosensitive drum 50 overlaps the cleaning opening 230 in the second direction.

1.4.2 Charging Device 51

The charging device 51 charges the circumferential surface of the photosensitive drum 50. In this embodiment, the charging device 51 is a scorotron type charger. The charging device 51 may be a charging roller.

1.5 Development Unit 6

The development unit 6 is configured to supply toner to the photosensitive drum 50. The development unit 6 includes a development roller 60 and a toner storage portion 61. In this embodiment, the development unit 6 is detachably supported by the drum unit 5. This enables individual replacement of the drum unit 5 including the photosensitive drum 50 and the development unit 6 including the development roller 60 and storing toner.

In a state where the drum unit 5 is attached to the housing 2 and the development unit 6 is attached to the drum unit 5, the drum unit 5 and the development unit 6 are arranged in the housing 2. In a state where the drum unit 5 and the development unit 6 are arranged in the housing 2, the development unit 6 is located between the photosensitive drum 50 and the second cover 3 in the first direction. The development unit 6 may be integrally formed with the drum unit 5.

1.5.1 Development Roller 60

The development roller 60 supplies toner to the photosensitive drum 50. In a state where the development unit 6 is attached to the drum unit 5, the development roller 60 is in contact with the photosensitive drum 50. The development roller 60 is rotatable about an axis A2. The axis A2 extends in the third direction. In a state where the drum unit 5 and development unit 6 are arranged in the housing 2, the photosensitive drum 50 is located at the opposite side of the second cover 3 with respect to the development roller 60 in the first direction.

1.5.2 Toner Storage Portion 61

The toner storage portion 61 stores toner. In a state where the drum unit 5 and the development unit 6 are arranged in the housing 2, the toner storage portion 61 is located at the opposite side of the photosensitive drum 50 with respect to the development roller 60.

1.6 LED Unit 7

In a state where the drum unit 5 is attached to the housing 2, the LED unit 7 is configured to expose the circumferential surface of the photosensitive drum 50. The LED unit 7 has a light emitting surface 70. The LED unit 7 emits light from the light emitting surface 70 and forms the light on the circumferential surface of the photosensitive drum 50.

1.7 Transfer Roller 8

The transfer roller 8 transfers the toner on the circumferential surface of the photosensitive drum 50 to the sheet S.

Specifically, the sheet S conveyed from the sheet cassette 4 toward the transfer roller 8 is conveyed to the fixing device 9 through between the transfer roller 8 and the photosensitive drum 50. At this time, the transfer roller 8 transfers the toner on the photosensitive drum 50 to the sheet S.

1.8 Fixing Device 9

The fixing device 9 heats and pressurizes the sheet S on which a toner image is transferred to fix the toner image on the sheet S. The sheet S that has passed through the fixing device 9 is discharged to the discharge tray 23 through the discharge opening 220.

1.9 Scanner 10

The scanner 10 is, for example, a flatbed scanner. The scanner 10 is supported by one end of the housing 2 in the second direction. Specifically, the scanner 10 is supported at the upper end of the housing 2. The scanner 10 is configured to move between a scanner first position (see FIG. 1) and a scanner second position (see FIG. 2). The scanner 10 is configured to rotatably move with respect to the housing 2 between the scanner first position (see FIG. 1) and the scanner second position (see FIG. 2). In a state where the scanner 10 is located at the scanner first position, the scanner 10 covers the discharge tray 23. In a state where the scanner 10 is located at the scanner second position, the scanner 10 is spaced apart from the discharge tray 23 in the second direction.

In a state where the scanner 10 is located at the scanner second position, the scanner 10 is farther away from the discharge tray 23 than at the scanner first position (see FIG. 2). Thus, a sufficient space can be secured between the discharge tray 23 and the scanner 10 in a state where the scanner 10 is located at the scanner second position. As a result, it is possible to suppress that the scanner 10 gets in the way of cleaning of the light emitting surface 70 of the LED unit 7 (see FIG. 3B).

2. Details of Housing 2

Figure 3B:
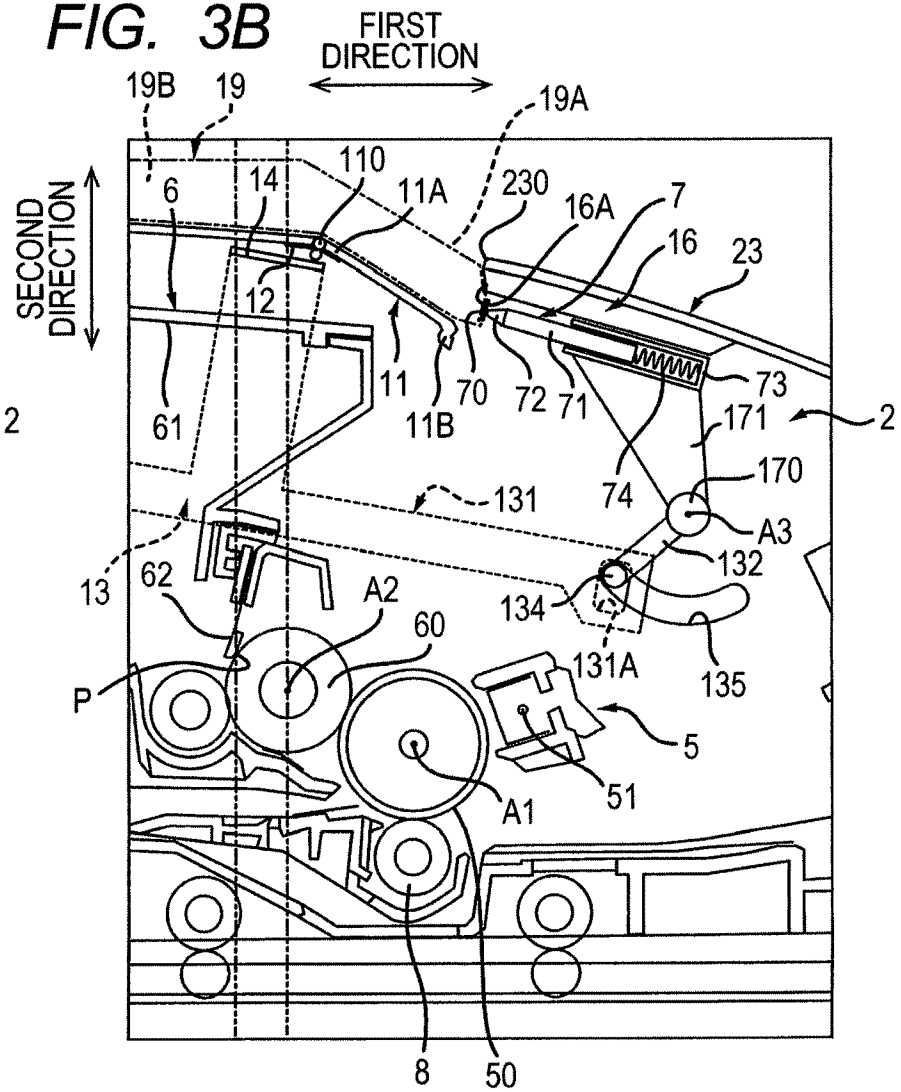
FIG. 3B is an enlarged view of the LED unit shown in FIG. 1, showing a state where the LED unit is located at a second position.
Figure 3A:
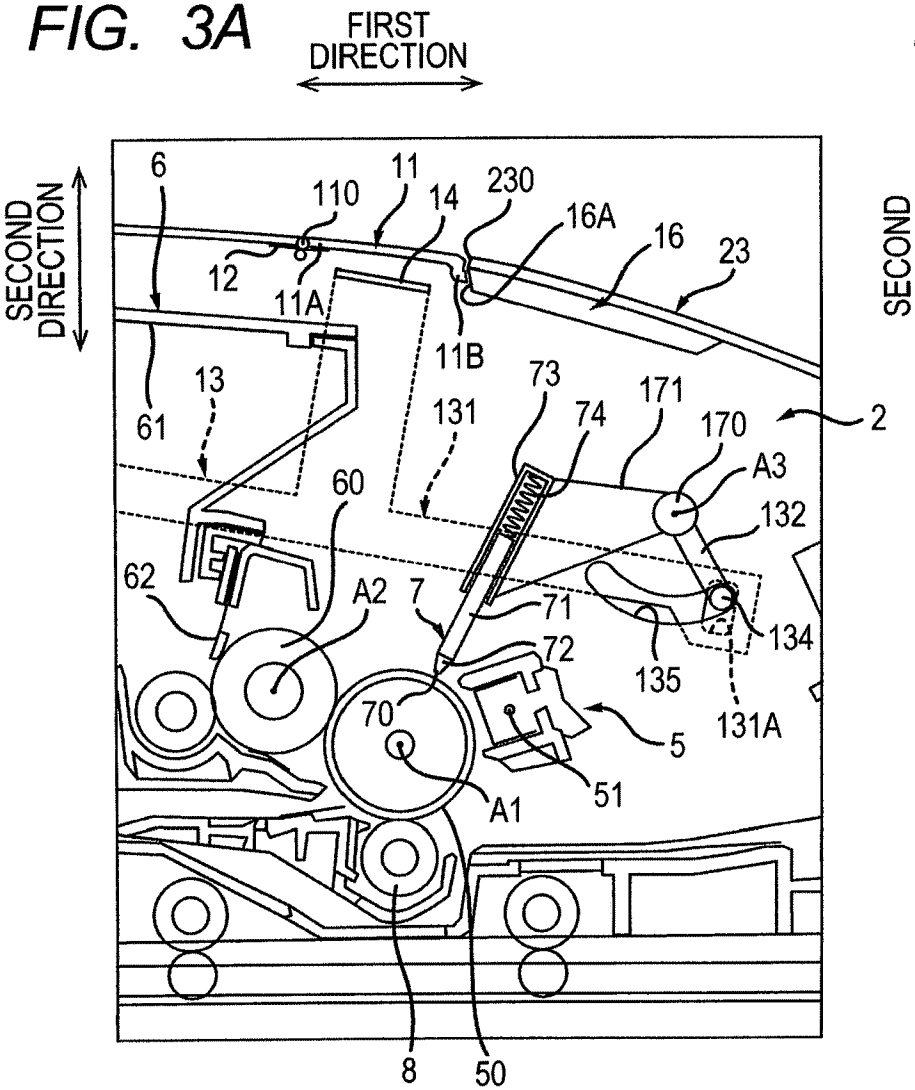
FIG. 3A is an enlarged view of an LED unit shown in FIG. 1, showing a state where the LED unit is located at a first position.

As shown in FIGS. 3A and 3B, the housing 2 includes a first cover 11 and a guide 16 in addition to the first side wall 20, the second side wall 21, the discharge portion 22, and the discharge tray 23. In other words, the image forming apparatus 1 further includes the first cover 11 and the guide 16.

2.1 First Cover 11

The first cover 11 is configured to move between a first closed position (see FIG. 3A) and a first open position (see FIG. 3B).

In a state where the first cover 11 is located at the first closed position, the first cover 11 closes the cleaning opening 230 (see FIG. 3A). In a state where the first cover 11 is located at the first closed position, the first cover 11 extends in the first direction along the discharge tray 23 (see FIG. 3A).

In a state where the first cover 11 is located at the first open position, the cleaning opening 230 opens (see FIG. 3B). In a state where the first cover 11 is located at the first open position, the first cover 11 is located within the housing 2 (see FIG. 3B). Thus, when the user pushes down the first cover 11, the cleaning opening 230 opens. As a result, the operability of the first cover 11 is improved.

The first cover 11 is rotatably moved about a first cover shaft 110 between the first closed position (see FIG. 3A) and the first open position (see FIG. 3B). The first cover shaft 110 extends in the third direction. The first cover 11 extends in a direction that intersects the third direction. In a state where the first cover 11 is located at the second closed position, the first cover 11 includes a first end 11A and a second end 11B in the first direction. The first end 11A is connected to the discharge tray 23. The first end 11A has a first cover shaft 110. The first end 11A is located at the opposite side of the discharge portion 22 (see FIG. 1) with respect to the second end 11B in the first direction. The second end 11B is located at the opposite side of the first side wall 20 (see FIG. 1) with respect to the first end 11A in the first direction. In a state where the first cover 11 is located at the first open position, the second end 11B is located within the housing 2.

2.2 Spring 12

The first cover 11 is maintained at the first closed position by a spring 12. The image forming apparatus 1 further includes the spring 12. The spring 12 pushes the first cover 11 toward the first closed position. The first cover 11 is movable from the first closed position to the first open position against the force of the spring 12 (see FIG. 3B). The first cover 11 is configured to move from the first open position to the first closed position by the force of the spring 12 (see FIG. 3A). The spring 12 is, for example, a torsion spring. One end of the spring 12 is supported by the first end 11A of the first cover 11. The other end of the spring 12 is supported by the discharge tray 23. The first cover 11 can be stably maintained at the first closed position by the spring 12.

2.3 Guide 16

The guide 16 is located within the housing 2. The guide 16 is supported by the discharge tray 23. The guide 16 extends along the discharge tray 23. In a state where the first cover 11 is located at the first closed position, the guide 16 is located at the opposite side of the first side wall 20 with respect to the first cover 11 in the first direction. The guide 16 has a cleaning guide surface 16A.

The cleaning guide surface 16A guides the cleaning of the light emitting surface 70 by a cleaning member 19 (see FIG. 3B). In a state where the first cover 11 is located at the first closed position, the cleaning guide surface 16A faces the second end 11B (see FIG. 3A). The cleaning guide surface 16A is an end surface of the guide 16 in the first direction.

3. Details of Development Unit 6

The development unit 6 further includes a layer-thickness regulating blade 62 in addition to the development roller 60 and the toner storage portion 61 described above.

3.1 Layer-Thickness Regulating Blade 62

The layer-thickness regulating blade 62 regulates the layer thickness of the toner borne on the surface of the development roller 60. In a state where the drum unit 5 and the development unit 6 are arranged within the housing 2, the layer-thickness regulating blade 62 is located at the opposite side of the photosensitive drum 50 with respect to the development roller 60. The layer-thickness regulating blade 62 extends in the second direction. The layer-thickness regulating blade 62 has one end and the other end in the second direction. The one end of the layer-thickness regulating blade 62 in the second direction is in contact with the circumferential surface of the development roller 60. The other end of the layer-thickness regulating blade 62 in the second direction is supported by the toner storage portion 61.

3.2 Toner Storage Portion 61

As shown in FIG. 3B, in a state where the drum unit 5 and the development unit 6 are arranged within the housing 2, at least part of the toner storage portion 61 is located at the opposite side of the second cover 3 (see FIG. 1) with respect to a contact position P between the development roller 60 and the layer-thickness regulating blade 62 in the first direction. In a state where the drum unit 5 and the development unit 6 are arranged within the housing 2, at least part of the toner storage portion 61 is located at the opposite side of the second cover 3 (see FIG. 1) with respect to a rotational axis A2 which is the rotational axis of the development roller 60 in the first direction. Thus, the capacity of the toner storage portion 61 is increased.

Further, in a state where the drum unit 5 and the development unit 6 are arranged within the housing 2, the toner storage portion 61 is located between the axis A1 of the photosensitive drum 50 and the second cover 3 (see FIG. 1) in the first direction.

4. Details of LED Unit 7

As shown in FIGS. 3A and 3B, the LED unit 7 includes a frame 71, an LED print head 72, a holder 73, and a coil spring 74.

4.1 Frame 71 and LED Print Head 72

The frame 71 supports the LED print head 72. The frame 71 has one end that supports the LED print head 72 and the other end that is located away from the one end.

Although not shown, the LED print head 72 includes an LED array composed of a plurality of LEDs and a lens array composed of a plurality of lenses. The LED print head 72 has the light emitting surface 70.

4.2 Holder 73 and Coil Spring 74

The holder 73 accommodates a part of the frame 71. Specifically, the holder 73 accommodates the other end of the frame 71 at the opposite side of the LED print head 72. The frame 71 is slidable relative to the holder 73.

The coil spring 74 is accommodated in the holder 73. The coil spring 74 is located at the opposite side of the LED print head 72 with respect to the frame 71.

4.3 First Position and Second Position of LED Unit 7

The LED unit 7 is configured to move between a first position (see FIG. 3A) and a second position (see FIG. 3B).

As shown in FIG. 3A, in a state where the LED unit 7 is located at the first position, the LED unit 7 is configured to expose the photosensitive drum 50. In a state where the LED unit 7 is located at the first position, the LED print head 72 is located between the frame 71 and the photosensitive drum 50. In a state where the LED unit 7 is located at the first position, the light emitting surface 70 faces the photosensitive drum 50.

As shown in FIG. 3B, in a state where the LED unit 7 is located at the second position, the light emitting surface 70 is closer to the cleaning opening 230 than a state where the LED unit 7 is located at the first position. In a state where the LED unit 7 is located at the second position, the holder 73 is located at the opposite side of the discharge tray 23 with respect to the guide 16 and is in contact with the guide 16. In a state where the LED unit 7 is located at the second position, the frame 71 extends along the discharge tray 23. In a state where the LED unit 7 is located at the second position, the LED print head 72 is located at the opposite side of the discharge portion 22 (see FIG. 1) with respect to the frame 71 in the first direction. In a state where the LED unit 7 is located at the second position, the light emitting surface 70 is aligned with the cleaning guide surface 16A of the guide 16 in the second direction.

The LED unit 7 is configured to rotatably move about a third axis A3 between the first position and the second position. The third axis A3 extends in the third direction.

5. Details of Image Forming Apparatus 1

The image forming apparatus 1 further includes a shaft 170, a connecting portion 171, a link mechanism 13, and a stopper 14.

5.1 Shaft 170 and Connecting Portion 171

The shaft 170 extends in the third direction. The shaft 170 is rotatably supported by the housing 2. The shaft 170 has a cylindrical shape. The connecting portion 171 connects the shaft 170 and the holder 73. With this configuration, the LED unit 7 is supported by the shaft 170 via the connecting portion 171. The LED unit 7 is configured to rotatably move about the third axis A3, which is the axis of the shaft 170.

5.2 Link Mechanism 13

As shown in FIG. 1, the link mechanism 13 links the movement of the second cover 3 with the movement of the LED unit 7. Thus, the operability of the LED unit 7 is improved as compared with a configuration in which the second cover 3 and the LED unit 7 are moved separately.

In a state where the second cover 3 is located at the second closed position, the LED unit 7 is located at the first position. Thus, in a state where the second cover 3 closes the opening 200, the LED unit 7 exposes the photosensitive drum 50. In a state where the second cover 3 is located at the second open position, the LED unit 7 is located at the second position (see FIG. 2). Thus, the light emitting surface 70 can be cleaned in a state where the opening 200 is open.

The link mechanism 13 includes a first link 130, a second link 131, a first boss 133, an arm 132, a second boss 134, and a third boss (not shown).

5.2.1 First Link 130

The first link 130 is supported by the second cover 3. In a state where the second cover 3 is located at the second closed position, the first link 130 is located within the housing 2. The first link 130 extends in an arc shape with the second cover shaft 30 as the center. The first link 130 has one end and the other end in the extending direction of the first link 130. The one end of the first link 130 is connected to the second cover 3. The other end of the first link 130 is located away from the one end of the first link 130.

The first link 130 has a first elongated hole 130A. The first elongated hole 130A is formed to penetrate the first link 130 in the third direction. The first elongated hole 130A extends in an arc shape. The first elongated hole 130A has one end and the other end in the extending direction of the first elongated hole 130A. The one end of the first elongated hole 130A is located at one end of the first link 130. The other end of the first elongated hole 130A is located at the other end of the first link 130.

5.2.2 Second Link 131

The second link 131 extends in the first direction. The second link 131 has one end and the other end in the first direction. The one end of the second link 131 in the first direction is aligned with the first link 130 in the third direction. The other end of the second link 131 in the first direction is located at the opposite side of the first side wall 20 with respect to the one end of the second link 131 in the first direction.

The second link 131 has a second elongated hole 131A. The second elongated hole 131A is located at the other end of the second link 131 in the first direction. The second elongated hole 131A is formed to penetrate the second link 131 in the third direction. The second elongated hole 131A extends in the second direction.

5.2.3 First Boss 133

The first boss 133 is supported at the one end of the second link 131 in the first direction. The first boss 133 extends in the third direction. The first boss 133 fits into the first elongated hole 130A. In a state where the second cover 3 is located at the second closed position, the first boss 133 is located at the one end of the first elongated hole 130A (see FIG. 1). In a state where the second cover 3 is located at the second open position, the first boss 133 is located at the other end of the first elongated hole 130A (see FIG. 2).

5.2.4 Arm 132

As shown in FIGS. 3A and 3B, the arm 132 connects the shaft 170 and the second link 131. The arm 132 extends in a radial direction of the shaft 170. The arm 132 is located spaced from the connecting portion 171 in the circumferential direction of the shaft 170. The arm 132 has one end and the other end in the radial direction of the shaft 170. The one end of the arm 132 is connected to the shaft 170. The other end of the arm 132 is located away from the shaft 170 in the radial direction of the shaft 170. The other end of the arm 132 is aligned with the second link 131 in the third direction.

5.2.5 Second Boss 134 and Third Boss

The second boss 134 is supported by the other end of the arm 132. The second boss 134 extends in the third direction. The second boss 134 fits into the second elongated hole 131A with a play in the second direction. A third boss (not shown) is supported by the other end of the arm 132. The third boss (not shown) is located at the opposite side of the second boss 134 with respect to the arm 132 in the third direction. The third boss (not shown) fits into a groove 135 of the housing 2. The groove 135 extends in an arc shape with the third axis A3 as the center. The groove 135 guides the movement of the third boss (not shown).

5.3 Stopper 14

The stopper 14 is configured to move between a stopper first position (see FIG. 3A) and a stopper second position (see FIG. 3B).

As shown in FIG. 3A, in a state where the stopper 14 is located at the stopper first position, the stopper 14 restricts the movement of the first cover 11 from the first closed position to the first open position. In a state where the stopper 14 is located at the stopper first position, the stopper 14 faces the first cover 11 in the second direction. In a state where the stopper 14 is located at the stopper first position, the stopper 14 is located between the first end 11A and the second end 11B in the first direction.

As shown in FIG. 3B, in a state where the stopper 14 is located at the stopper second position, the first cover 11 is movable from the first closed position to the first open position. In a state where the stopper 14 is located at the stopper second position, the stopper 14 is located at the opposite side of the discharge portion 22 (see FIG. 2) with respect to the first cover 11 in the first direction.

The stopper 14 is supported by the link mechanism 13. Specifically, the stopper 14 is supported by the second link 131. The stopper 14 extends in the second direction from the second link 131 toward the discharge tray 23. Thus, the movement of the stopper 14, the movement of the second cover 3, and the movement of the LED unit 7 are linked.

As shown in FIG. 3A, in a state where the second cover 3 is located at the second closed position (see FIG. 1), the LED unit 7 is located at the first position and the stopper 14 is located at the stopper first position. Thus, in a state where the second cover 3 closes the opening 200 (see FIG. 1) and the LED unit 7 exposes the photosensitive drum 50, the stopper 14 restricts movement of the first cover 11 from the first closed position to the first open position. As a result, it is possible to prevent the cleaning opening 230 from opening during an image forming operation of the image forming apparatus 1.

As shown in FIG. 3B, in a state where the second cover 3 is located at the second open position (see FIG. 2), the LED unit 7 is located at the second position and the stopper 14 is located at the stopper second position. In a state where the LED unit 7 is located at the second position and the stopper 14 is located at the stopper second position, the stopper 14 is located at the opposite side of the LED unit 7 with respect to the first cover 11. Thus, in a state where the opening 200 is open (see FIG. 2) and the light emitting surface 70 is relatively close to the cleaning opening 230, the first cover 11 is movable from the first closed position to the first open position so that the cleaning opening 230 is opened.

6. Cleaning Operation

Next, a cleaning operation of the light emitting surface 70 of the LED unit 7 will be described with reference to FIGS. 1 to 3B.

In the cleaning operation, as shown in FIGS. 1 and 2, the second cover 3 rotatably moves from the second closed position to the second open position. Then, the first link 130 moves together with the second cover 3. As a result, the first boss 133 moves from the one end to the other end of the first elongated hole 130A. In a state where the first boss 133 is located at the other end of the first elongated hole 130A, the first boss 133 contacts the first link 130 in the first direction. Then, the first boss 133 is pulled toward the first side wall 20 in the first direction. The second link 131 is pulled together with the first boss 133. With this operation, the second link 131 moves in the first direction.

Then, as shown in FIGS. 3A and 3B, the stopper 14 moves from the stopper first position to the stopper second position. Further, the second boss 134 is pulled toward the first side wall 20 in the first direction by the movement of the second link 131. Then, the shaft 170 rotates. As a result, the LED unit 7 rotatably moves about the third axis A3 from the first position to the second position.

Then, as shown in FIG. 3B, the first cover 11 moves from the first closed position to the first open position against the force of the spring 12. With this operation, the cleaning opening 230 opens. After that, the cleaning member 19 cleans the light emitting surface 70 through the cleaning opening 230.

The cleaning member 19 has a first portion 19A and a second portion 19B. The first portion 19A moves into the housing 2 through the cleaning opening 230. The first portion 19A contacts the cleaning guide surface 16A and also contacts the light emitting surface 70 of the LED unit 7 in the housing 2. The second portion 19B is located outside the housing 2 and is gripped by the user. In a state where the first portion 19A is located in the housing 2, the second portion 19B is located at the opposite side of the LED unit 7 with respect to the first portion 19A.

The cleaning member 19 moves in a state where the first portion 19A is in contact with the cleaning guide surface 16A and the light emitting surface 70. With this operation, the light emitting surface 70 is cleaned.

7. Operations and Effects

In the image forming apparatus 1, in a state where the LED unit 7 is located at the second position, the light emitting surface 70 is closer to the cleaning opening 230 than the state where the LED unit 7 is located at the first position.

Thus, in a state where the drum unit 5 is attached to the housing 2 and the LED unit 7 is located at the second position, the light emitting surface 70 can be cleaned smoothly through the cleaning opening 230.

8. Second Embodiment

Next, a second embodiment will be described with reference to FIGS. 4 and 5. In the second embodiment, the same members as those in the first embodiment are designated by the same reference numerals, and the description thereof will be omitted.

8.1 Details of Housing 2

Figure 4:
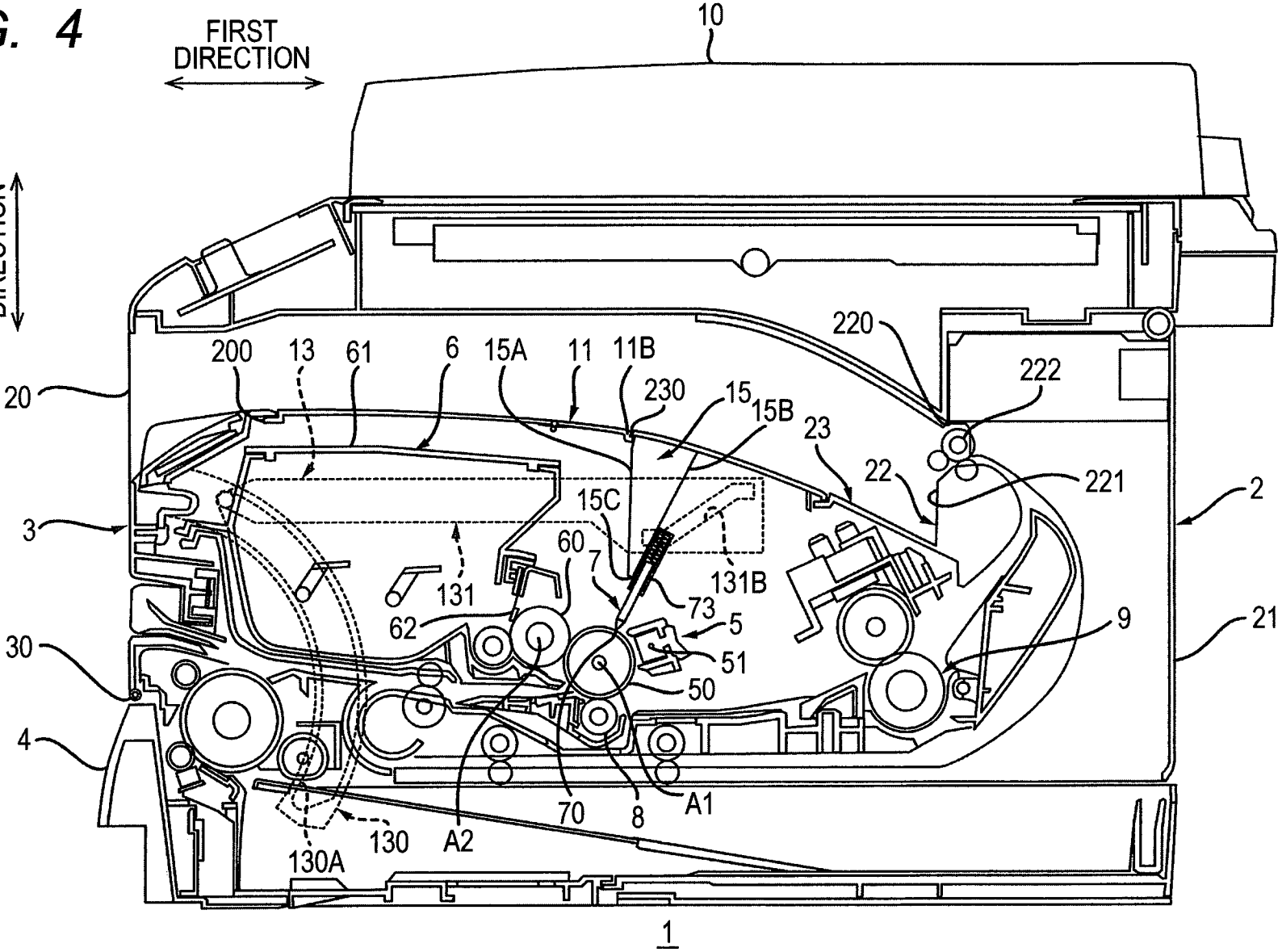
FIG. 4 is a cross-sectional view of an image forming apparatus of a second embodiment, showing a state where a second cover is located at a second closed position.
Figure 5:
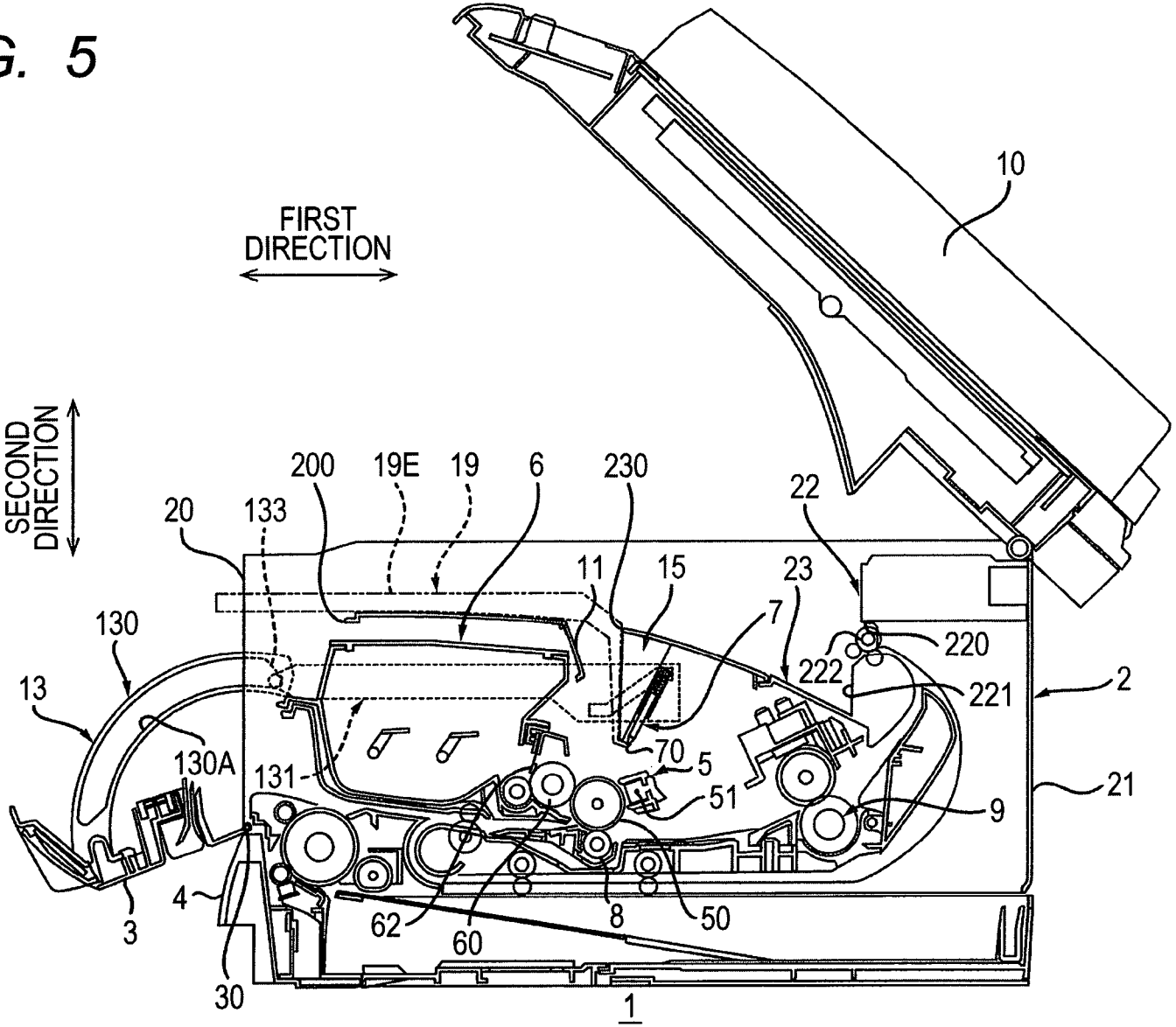
FIG. 5 shows the image forming apparatus shown in FIG. 4, in which the second cover is located at a second open position.

As shown in FIGS. 4 and 5, in the second embodiment, the housing 2 includes a wall 15 instead of the guide 16. In other words, the image forming apparatus 1 includes the wall 15.

8.1.1 Wall 15

The wall 15 is located within the housing 2. The wall 15 is supported by the discharge tray 23. In a state where the first cover 11 is located at the first closed position, the wall 15 is located at the opposite side of the first side wall 20 with respect to the first cover 11 in the first direction. The wall 15 protrudes from the discharge tray 23 in the second direction. The wall 15 has a cleaning guide surface 15A and a guide surface 15B.

8.1.2 Cleaning Guide Surface 15A

Figure 6B:
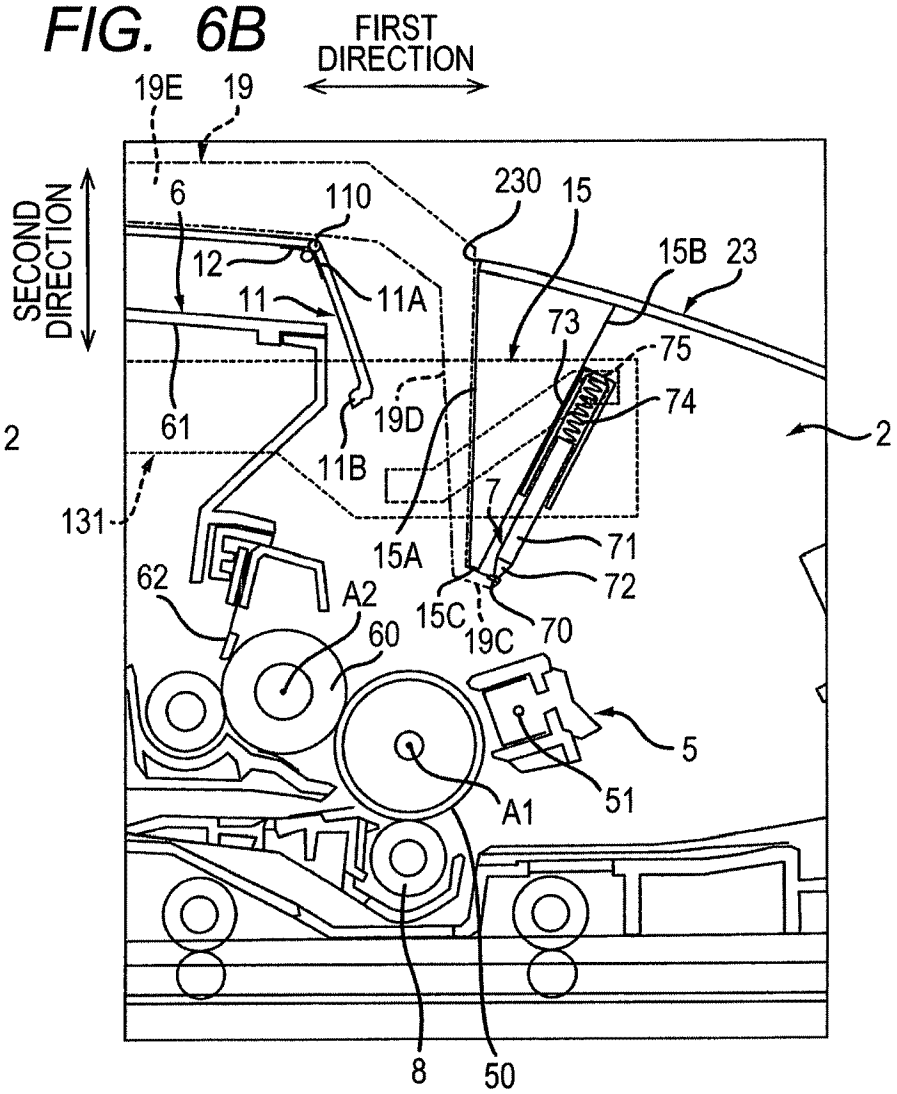
FIG. 6B is an enlarged view of the LED unit shown in FIG. 5, showing a state where the LED unit is located at a second position.
Figure 6A:
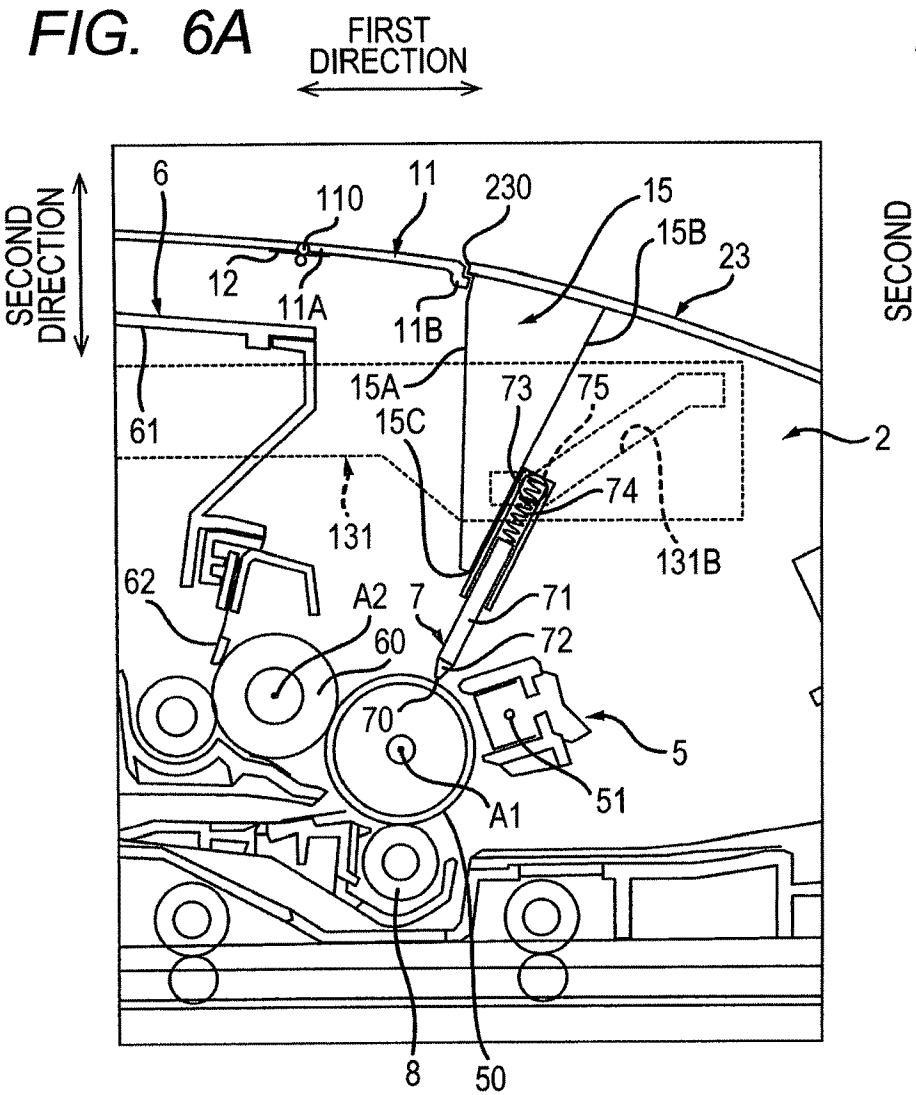
FIG. 6A is an enlarged view of an LED unit shown in FIG. 5, showing a state where the LED unit is located at a first position.

As shown in FIGS. 6A and 6B, the cleaning guide surface 15A guides the cleaning of the light emitting surface 70 by the cleaning member 19 (see FIG. 6B). The cleaning guide surface 15A is located at the opposite side of the discharge portion 22 with respect to the guide surface 15B in the first direction. The cleaning guide surface 15A extends in the second direction. The cleaning guide surface 15A has one end and the other end in the second direction. The one end of the cleaning guide surface 15A in the second direction is continuous with the discharge tray 23. In a state where the first cover 11 is located the first closed position, the one end of the cleaning guide surface 15A in the second direction faces the second end 11B. The other end of the cleaning guide surface 15A in the second direction is located away from the one end of the cleaning guide surface 15A in the second direction.

8.1.3 Guide Surface 15B

The guide surface 15B guides the movement of the LED unit 7. Thus, the LED unit 7 moves in a stable manner. The guide surface 15B is located at the opposite side of the first cover 11 with respect to the cleaning guide surface 15A in the first direction. The guide surface 15B is in contact with the holder 73 of the LED unit 7. The guide surface 15B is located at the opposite side of the first side wall 20 with respect to the cleaning guide surface 15A in the first direction. The guide surface 15B is inclined in a direction away from the first side wall 20 toward the cleaning opening 230 in the second direction. The guide surface 15B extends in a direction that intersects the first direction and the second direction. The guide surface 15B has one end and the other end in the direction in which the guide surface 15B extends. The one end of the guide surface 15B is continuous with the discharge tray 23. The other end of the guide surface 15B is located away from the one end of the guide surface 15B in the second direction. The other end of the guide surface 15B is connected to the other end of the cleaning guide surface 15A. The other end of the cleaning guide surface 15A and the other end of the guide surface 15B define a vertex portion 15C of the wall 15.

8.2 Details of LED Unit 7

The LED unit 7 has a guide boss 75 in addition to the frame 71, the LED print head 72, the holder 73, and the coil spring 74 described above.

The guide boss 75 protrudes from the holder 73 in the third direction. The guide boss 75 fits into a guide hole 131B of the second link 131.

The second link 131 has the guide hole 131B instead of the second elongated hole 131A. The guide hole 131B is formed to penetrate the second link 131 in the third direction. The guide hole 131B extends in a direction that intersects the first direction and the second direction. The guide hole 131B approaches the discharge tray 23 in the second direction, in a direction away from the first side wall 20 in the first direction.

The LED unit 7 is configured to slidably move between a first position (see FIG. 6A) and a second position (see FIG. 6B). As the LED unit 7 moves from the first position to the second position, the light emitting surface 70 moves away from the first side wall 20 in the first direction.

As shown in FIG. 6B, in a state where the LED unit 7 is located at the second position, the wall 15 is located between the LED unit 7 and the cleaning opening 230. Thus, the wall 15 protects the LED unit 7 in a state where the LED unit 7 is located at the second position.

In a state where the LED unit 7 is located at the second position, the vertex portion 15C of the wall 15 (that is, a part of the wall 15) is located between the light emitting surface 70 and the cleaning opening 230. Thus, the vertex portion 15C of the wall 15 protects the light emitting surface 70. In a state where the LED unit 7 is located at the second position, the vertex portion 15C of the wall 15 and the light emitting surface 70 are aligned in a direction perpendicular to the moving direction of the LED unit 7 and the third direction.

8.3 Cleaning Operation

In the second embodiment, in a state where the second cover 3 is located at the second open position and the LED unit 7 is located at the second position, the first cover 11 can be moved from the first closed position to the first open position. With this operation, the cleaning opening 230 opens. After that, the cleaning member 19 cleans the light emitting surface 70 through the cleaning opening 230.

The cleaning member 19 has a first portion 19C, a second portion 19D, and a third portion 19E. The first portion 19C and the second portion 19D enter the housing 2 through the cleaning opening 230. The first portion 19C is located at one end of the cleaning member 19. The first portion 19C is located at the opposite side of the third portion 19E with respect to the second portion 19D. The first portion 19C contacts the vertex portion 15C and also contacts the light emitting surface 70 of the LED unit 7 within the housing 2. The second portion 19D extends in the second direction. The second portion 19D contacts the cleaning guide surface 15A in the housing 2. The third portion 19E is located outside the housing 2 and is gripped by the user.

The cleaning member 19 moves in a state where the second portion 19D contacts the cleaning guide surface 15A and the first portion 19C contacts the vertex portion 15C and the light emitting surface 70. With this operation, the light emitting surface 70 is cleaned.

In the second embodiment, the similar effects to those of the first embodiment can be obtained.

While the disclosure has been described in detail with reference to the above aspects thereof, it would be apparent to those skilled in the art that various changes and modifications may be made therein without departing from the scope of the claims.

What is claimed is:

1. An image forming apparatus comprising:

a photosensitive drum;

an LED unit configured to expose the photosensitive drum, the LED unit having a light emitting surface; and a housing including:

a discharge portion having a discharge opening configured to discharge a sheet; and a discharge tray having a sheet placement surface on which the sheet discharged from the discharge opening is placed, the discharge tray having a cleaning opening for cleaning the light emitting surface of the LED unit, the cleaning opening being formed in the sheet placement surface;

the LED unit being configured to move between:

a first position at which the LED unit exposes the photosensitive drum; and a second position at which the light emitting surface is closer to the cleaning opening than a state where the LED unit is located at the first position.

2. The image forming apparatus according to claim 1, further comprising a first cover configured to move between a first open position at which the first cover opens the cleaning opening and a first closed position at which the first cover closes the cleaning opening, wherein the first cover is located within the housing in a state where the first cover is located at the first open position; and wherein the first cover extends continuously along the sheet placement surface of the discharge tray in a state where the first cover is located at the first closed position.

3. The image forming apparatus according to claim 2, further comprising a spring configured to press the first cover toward the first closed position.

4. The image forming apparatus according to claim 2, wherein the housing includes a first side wall having an opening and a second side wall spaced from the first side wall in a first direction; and wherein the image forming apparatus further comprises:

a second cover configured to move between a second open position at which the second cover opens the opening and a second closed position at which the second cover closes the opening; and a drum unit including the photosensitive drum, the drum unit being configured to be attached to the housing through the opening.

5. The image forming apparatus according to claim 4, further comprising a stopper configured to move between a stopper first position at which the stopper restricts movement of the first cover from the first closed position to the first open position and a stopper second position at which the stopper allows the first cover to move from the first closed position to the first open position, wherein the stopper is configured to:

be located at the stopper first position in a state where the second cover is located at the second closed position; and to be located at the stopper second position in a state where the second cover is located at the second open position.

6. The image forming apparatus according to claim 5, wherein the LED unit is configured to:

be located at the first position in a state where the second cover is located at the second closed position; and be located at the second position in a state where the second cover is located at the second open position.

7. The image forming apparatus according to claim 6, further comprising a link mechanism configured to link movement of the second cover with movement of the LED unit, wherein the stopper is supported by the link mechanism.

8. The image forming apparatus according to claim 4, wherein the LED unit is configured to rotatably move between the first position and the second position.

9. The image forming apparatus according to claim 4, wherein the LED unit is configured to slidably move between the first position and the second position; and wherein, as the LED unit moves from the first position toward the second position, the light emitting surface moves away from the first side wall in the first direction.

10. The image forming apparatus according to claim 9, further comprising a wall located between the LED unit and the cleaning opening in a state where the LED unit is located at the second position.

11. The image forming apparatus according to claim 10, wherein the wall has a guide surface that is inclined in a direction away from the first side wall toward the cleaning opening, the guide surface being configured to guide movement of the LED unit.

12. The image forming apparatus according to claim 10, wherein, in a state where the LED unit is located at the second position, at least part of the wall is located between the light emitting surface and the cleaning opening.

13. The image forming apparatus according to claim 4, further comprising a development unit including:

a development roller configured to supply toner to the photosensitive drum; and a toner storage portion configured to store toner, wherein the photosensitive drum is located at an opposite side of the second cover with respect to the development roller in the first direction.

14. The image forming apparatus according to claim 13, wherein at least part of the toner storage portion is located at an opposite side of the second cover with respect to a rotational axis of the development roller in the first direction.

15. The image forming apparatus according to claim 13, wherein the development unit includes a layer-thickness regulating blade configured to contact a circumferential surface of the development roller; and wherein at least part of the toner storage portion is located at an opposite side of the second cover with respect to a contact position between the development roller and the layer-thickness regulating blade in the first direction.

16. The image forming apparatus according to claim 13, wherein the development unit is detachably supported by the drum unit.

17. The image forming apparatus according to claim 1, further comprising a scanner, wherein the scanner is configured to move between a scanner first position at which the scanner covers the discharge tray and a scanner second position at which the scanner is spaced farther away from the discharge tray than at the scanner first position.

18. The image forming apparatus according to claim 4, wherein the housing includes a guide supported by the discharge tray and extending along the discharge tray;

wherein, in a state where the first cover is located at the first closed position, the guide is located at an opposite side of the first side wall with respect to the first cover in the first direction;

wherein the guide has a cleaning guide surface configured to guide cleaning of the light emitting surface by a cleaning member;

wherein, in a state where the first cover is located at the first closed position, the cleaning guide surface faces an end of the first cover; and wherein, in a state where the LED unit is located at the second position, the light emitting surface is aligned with the cleaning guide surface in a vertical direction.

19. The image forming apparatus according to claim 11, wherein the wall further has a cleaning guide surface configured to guide cleaning of the light emitting surface by a cleaning member;

wherein the wall has a vertex portion defined by an end of the cleaning guide surface and an end of the guide surface;

wherein, in a state where the LED unit is located at the second position, the vertex portion is located between the light emitting surface and the cleaning opening; and wherein, in a state where the LED unit is located at the second position, the vertex portion and the light emitting surface are aligned in a direction perpendicular to a moving direction of the LED unit and to an axial direction of the photosensitive drum.

20. The image forming apparatus according to claim 2, wherein the first cover includes a first end and a second end opposite the first end in a sheet discharge direction in a state where the first cover is located at the first closed position, the first end being connected to the discharge tray, the first end having a first cover shaft;

wherein the first cover is rotatably movable about the first cover shaft between the first closed position and the first open position; and wherein the second end is located within the housing in a state where the first cover is located at the first open position.

* * * * *